United States Patent [19]

Fitch et al.

[11] 4,232,614

[45] Nov. 11, 1980

[54] PROCESS OF INCINERATION WITH PREDRYING OF MOIST FEED USING HOT INERT PARTICULATES

[75] Inventors: Elliot B. Fitch, Auburn, Ala.; Orris E. Albertson, Salt Lake City, Utah

[73] Assignee: Dorr-Oliver Incorporated, Stamford, Conn.

[21] Appl. No.: 46,392

[22] Filed: Jun. 6, 1979

Related U.S. Application Data

[63] Continuation-in-part of Ser. No. 856,379, Dec. 1, 1977, Pat. No. 4,159,682.

[51] Int. Cl.[3] ..... F23G 5/04

[52] U.S. Cl. ..... 110/235; 110/224; 110/238; 110/245; 110/246; 110/346

[58] Field of Search ..... 110/235, 238, 243, 245, 110/246, 254, 219, 221, 224, 229, 346; 432/15, 58

[56] References Cited

U.S. PATENT DOCUMENTS

| | | | |
|---|---|---|---|
| 3,306,236 | 2/1967 | Campbell | 110/216 |
| 3,907,674 | 9/1975 | Roberts et al. | 110/245 X |
| 3,913,500 | 10/1975 | Paccione | 110/245 X |

*Primary Examiner*—Edward G. Favors

[57] ABSTRACT

Moist combustible matter is burned in a combustion zone following a drying treatment in which the combustible matter is brought into contact with hot, inert particulates circulated from the combustion zone. The water in the combustible matter is evaporated at a relatively low temperature in the drying zone, thereby conserving heat in the system. The exhaust gas stream from the drying zone is handled separately from the reactor exhaust gases to condense the water vapor therein, the water is removed from the process and the remaining gas is subjected to odor-destroying high temperature.

4 Claims, 3 Drawing Figures

Figure 1:
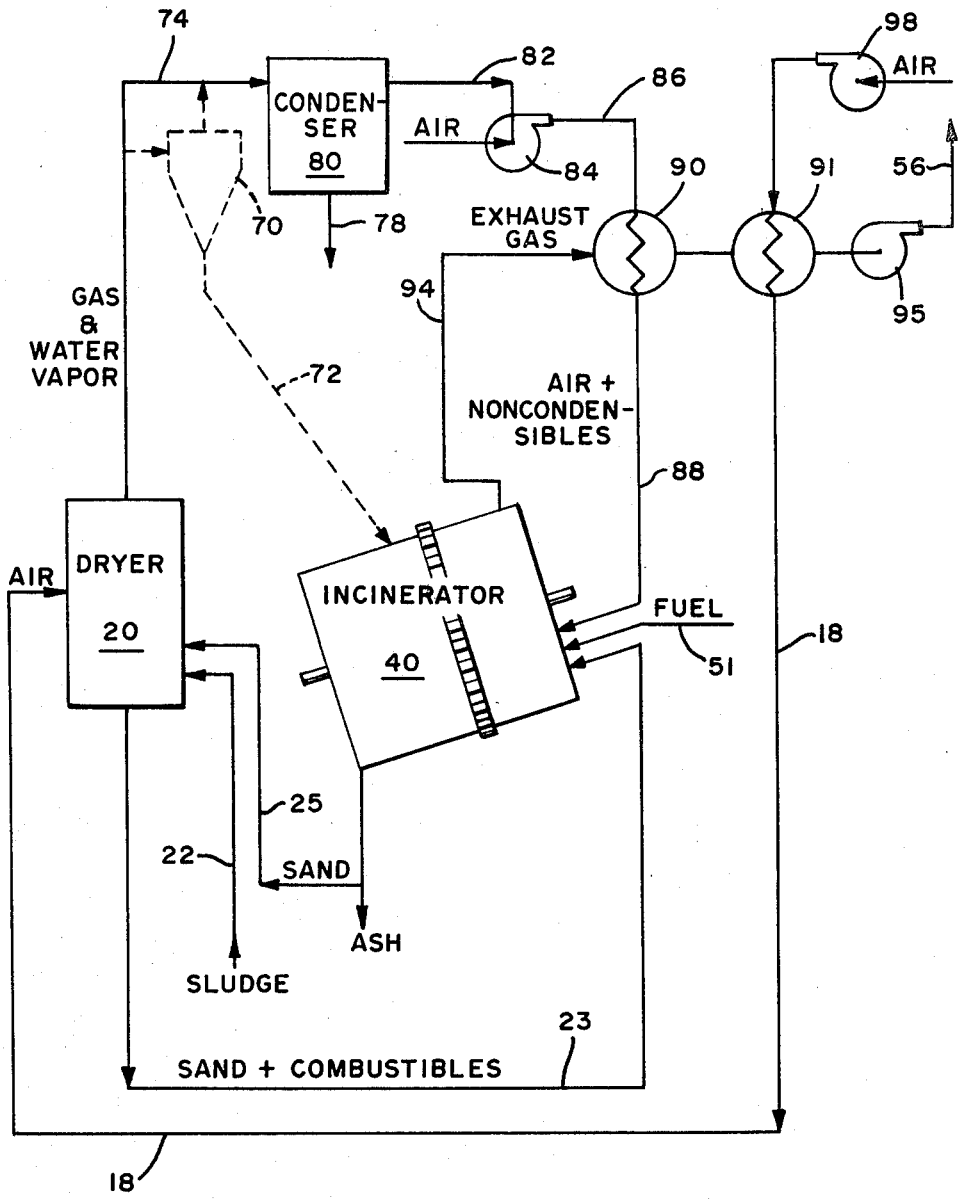

PROCESS OF INCINERATION WITH PREDRYING OF MOIST FEED USING HOT INERT PARTICULATES

This application is a continuation-in-part of application Ser. No. 856,379, filed Dec. 1, 1977 now U.S. Pat. No. 4,159,682.

Incineration has for its purpose the complete destruction of the organic matter in the waste feed stream, leaving as a residue only an inert ash, and the performance of this combustion reaction in a manner which does not produce objectionable odors. Odorless combustion is achieved by complete oxidation of the organic matter in the waste feed stream and requires, as a practical matter, temperatures at least in the range from about 700° C. to about 800° C. depending upon the percent of excess air.

While it has always been desirable to minimize the fuel consumption of incineration processes, this has become of increasing concern with the recent scarcity and high cost of fuel. In this connection, it is desirable to evaporate the water associated with the organic waste sludges in the most economical manner possible. Feeding the waste sludge directly into the incinerator causes evaporation of the water at the unnecessarily high temperature of 700° C. or more and results in a substantial waste of fuel.

Incinerators burning a fuel such as peat, may also be employed to generate steam for power by providing steam coils in the combustion zone. The heat generated in such a unit may also be used to supply the heat required to carry out certain processes, including chemical processes.

It has been suggested that the excess heat in the incinerator exhaust gases might be transferred indirectly therefrom to the incoming moist feed, distilling off the water and leaving a residue of dry solids for combustion. However, this procedure offers very real difficulties both in the area of heat transfer and materials handling. This alternative is not commercially attractive.

Of course, sensible heat from the exhaust gases can be transferred to the incoming combustion air. This is, as a matter of fact, commonly done, but is only a partial answer to the problem. The quantity of exhaust gases is much larger than that of the incoming air, because of the very large amount of water vapor that the exhaust gases contain. Even with perfect heat transfer, the incoming air would be able to take up and thus recuperate only a fraction of the sensible heat in the discharge gases from the combustion reactor.

There is thus a very real need for a combustion system that will operate efficiently with a moist combustible feed and for an incinerating system which can effectively destroy high-moisture containing organic waste sludges, yet hold fuel consumption to as low a level as possible.

Accordingly, it is an object of the invention to provide an improved, economical method and system for drying a moist, combustible feed prior to introduction into the combustion zone of an incinerator.

If is a further object of the present invention to provide an improved process and system for drying a moist combustible feed using heat from a subsequent incineration step to evaporate water at a relatively low temperature.

Still another object of the invention to provide a combustion system in which the heat present in inert particulates circulated through the combustion zone of an incinerator is employed to dry a moist combustible feed.

Figure 2:
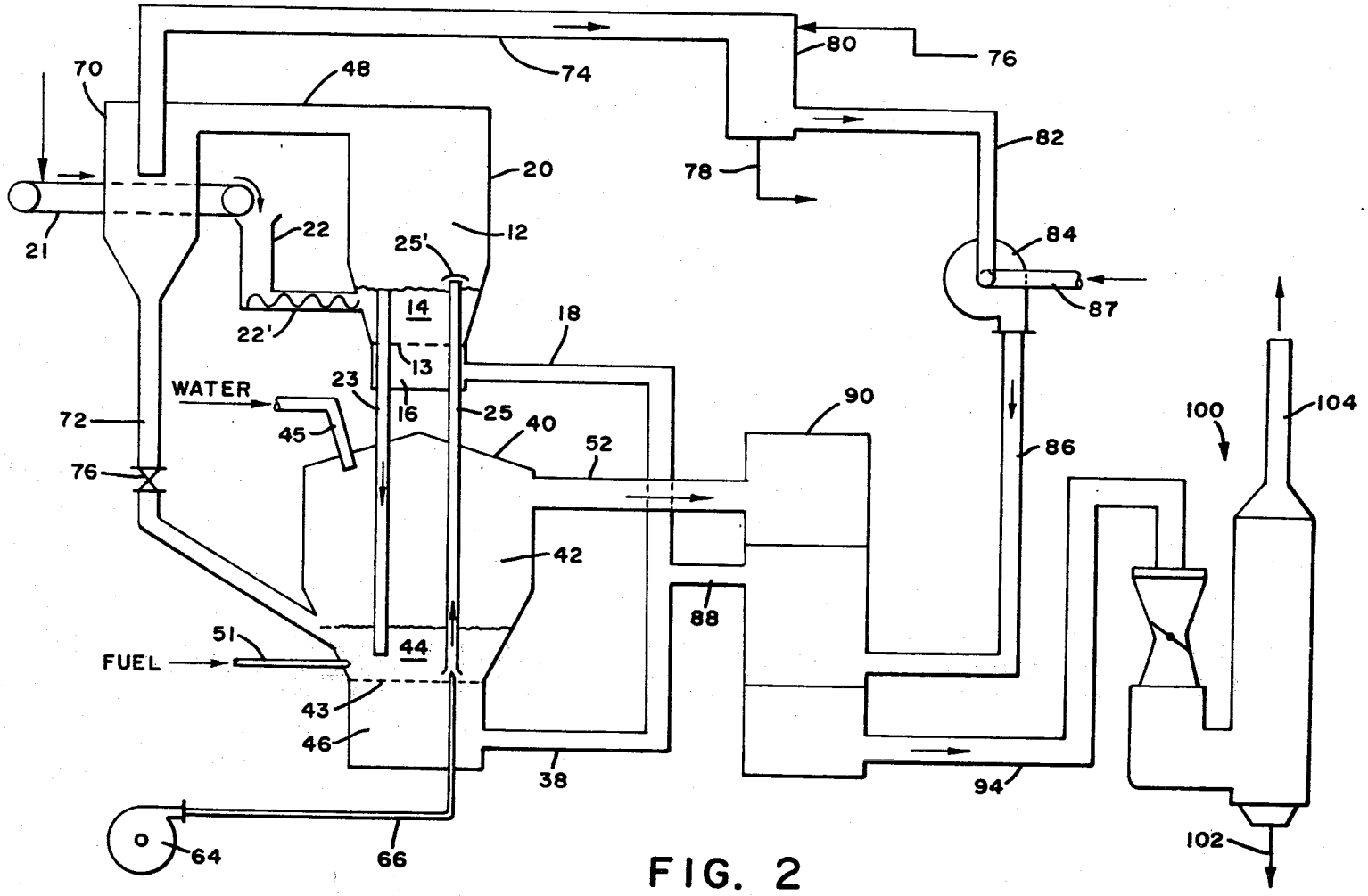
Figure 2A:
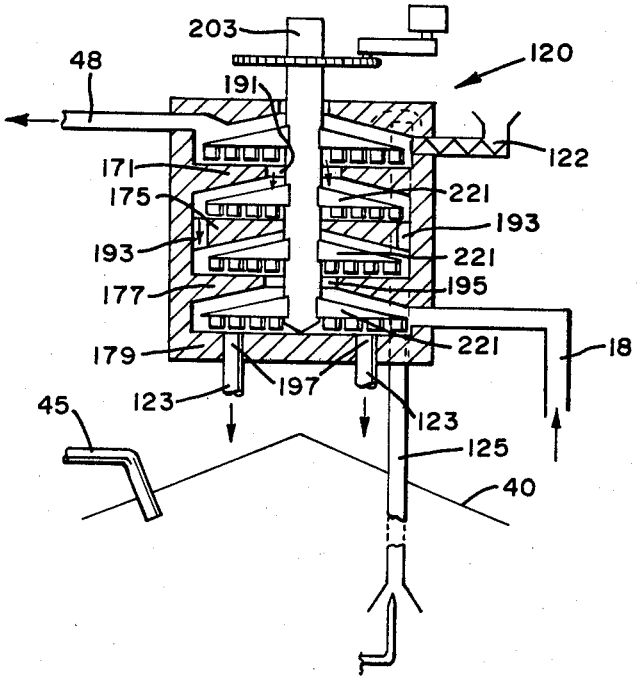

Other objects and advantages will become apparent from the following description taken in conjunction with the accompanying drawings in which:

FIG. 1 is a schematic diagram of a combustion system embodying the features of the present invention, FIG. 2 is a schematic diagram of an alternate embodiment of the invention, and FIG. 2*a* is a modification of the embodiment of FIG. 2.

Generally speaking, the present invention involves incineration of a moist feed such as peat, sawdust, hog fuel and sewage or industrial sludge. In this process a circulating load of hot, inert particulate material, such as sand, is exposed to high temperature in a combustion zone and is thereafter removed from the combustion zone to be brought into drying contact with the moist feed in a drying zone to vaporize the water at relatively low temperature, and then is recycled to the combustion zone with dried feed; the inert particles for reheating and the dried feed for combustion. In carrying out this process, the water vapor generated by evaporation in the drying zone is condensed in a condensation zone from the low temperature off-gases of the drying step and is removed as liquid. Any remaining non-condensible gases are conducted to the combustion zone where they are heated to a temperature of at least 700° C. thereby eliminating any odor.

The drying of the moist feed, as described, may be carried out in a number of different devices capable of bringing the hot sand into contact with the feed and generally providing a confined volume. One such device is a pug mill and others are: a rotating drum dryer, a multiple hearth dryer, a simple covered mixing tank provided with stirring or agitating means and a fluidized bed dryer.

The moist feed may consist, as a practical matter, of from about 5% up to about 50% or more of solids. Sewage sludge will usually fall in the lower portion of this range, perhaps up to 30% solids, and a material such as hog fuel may be in the range of 50% or more of solids.

The combination zone may be provided by various devices suitable for combustion such as, but not limited to, a rotary kiln, a multiple hearth furnace, a fluidized bed reactor.

The condensation zone may be provided by a conventional scrubber-cooler as a condenser.

More specifically, then, the combustion zone operates at a relatively high temperature, say 700° C. or more, while the drying zone operates at a substantially lower temperature, say in the range from 80° to 180° C. The heat necessary to perform the evaporation function in the combustion zone is supplied by transferring a portion of the hot, inert particulate material from the combustion zone to the drying zone. The inert particulate material from the combustion zone enters the drying zone at a relatively high temperature, but is quickly cooled to a temperature of, say 125° C., in the drying zone, which is also receiving moist feed introduced at ambient temperature. Evaporation of water from the moist feed is efficiently carried out at this relatively low temperature with the exhaust gases and vapor from the dryer zone leaving at a temperature of about 125° C. The exhaust gases from the drying zone are conducted through a scrubber-cooler to condense the water vapor and the remaining non-condensible gas and air are forwarded to the combustion zone so they are subjected to the high temperature therein for elimination of odors.

Referring now to FIG. 1, certain important features of this novel combustion system, as applied in the incineration of sewage sludge, are illustrated in the form of a simplified schematic diagram. The principal units of the system which are shown in FIG. 1 are an incinerator 40, a condenser 80, heat exchangers 90 and 91 and a drying unit 20. An optional cyclone 70 is also shown (in phantom) for removng solids from the exhaust gases of the dryer 20, if required. In operation, a moist organic sludge is introduced through line 22 into dryer unit 20 for mixture therein with hot particulates supplied through line 25 from the combustion zone or incinerator 40. The sludge entering the dryer unit 20 is quickly raised to a temperature of about 125° C. and the moisture in the sludge is evaporated; the sweep air provided through line 22 becomes well moisturized in passing through dryer unit 20 and is exhausted from the drying unit 20 through the conduit 74 leading to the condenser 80 and heat exchanger 90. In the condenser 80 the water vapor is condensed and removed as water through line 78 while the non-condensible gas is forwarded to the heat exchanger 90 by compressor 84. The dried sludge together with some inert particulates, is removed from the drying unit 20 through the conduit 23 which is connected between the drying unit 20 and the incinerator 40. The incinerator unit 40 is shown schematically as a rotary kiln, but it may be another type of combustion unit; i.e., a multiple hearth furnace or a fluidized bed incinerator. Combustion air is supplied to the incinerator 40 through the conduit 88. This combustion air has traversed heat exchanger 90 with the non-condensible gas from the condenser 80 and has been heated to an elevated temperature in the range of 350° C. to 550° C. It will be understood that the temperature within the incinerator 40 is substantially higher than that within the drying unit 20 and fuel, such as fuel oil, may be injected into the incinerator 40 through line 51 to maintain a desired temperature therein. The temperature within incinerator 40 may be, for example, 700° C. and, particulates and/or sand from the incinerator is conveyed to the drying unit 20 by line 25 which may represent a mechanical or pneumatic conveying means. The exhaust gases from incinerator unit 40 are conducted away through exhaust conduit 94 and are drawn successively by blower 95 through heat exchangers 90 and 91. From blower 95 the exhaust gas passes through exhaust line 56 to a venturii scrubber and exhaust stack (these last elements not shown). In the heat exchanges 90 and 91, the heat in the exhaust gases is recuperated by heat exchange with the gases from the drying unit 20 as they pass through the heat exchanger 90 enroute to the incinerator unit 40 and by further heat exchange with air supplied by compressor 98.

In the embodiment disclosed in FIG. 2, which is a schematic diagram of a fluidized bed system in which the fluidized bed incinerator is positioned below a fluidized bed dryer unit.

In the system of FIG. 2, moist sludge is fed by a belt conveyor 21 to a screw feeder 22 which forces the sludge into the dryer unit 20 below the upper surface of the fluidized bed 14. Preheated air is introduced into the wind box 16 of the dryer unit 20 from line 18 and this air passes the constriction plate 13 to fluidize the bed 14 in dryer chamber 21 and then, with the moisture evaporated from the sewage sludge, passes into the freeboard region of dryer chamber 12. Inert bed material and dried sludge flow over the upper end of transfer pipe 23, thus falling into incinerator unit 40. Hot bed sand is air-lifted into the dryer unit 20 through transfer pipe 25 which extends from the fluid bed 44 of incinerator unit 40 into the bed 14 of the dryer unit. A blower 64 and a conduit 66 cooperate with the transfer pipe 25 to provide the air-lift system. The conduit 66 discharges into the open lower end of transfer pipe 25 creating a venturii effect which draws hot particulate bed material into transfer pipe 25 for delivery into bed 14. The upper end of transfer pipe 25 may be provided with a baffle plate 25' to deflect the hot particulate material onto the bed 14. The gases in the dryer chamber 12 exit through conduit 48 which leads into the cyclone 70 wherein the solids are separated from the gas and vapor, with solids being returned to the incinerator 40 through the valved conduit 72. Valve 76 in conduit 72 may be of the trickle valve type. The gas and vapor present in the cyclone exit through conduit 74 and are forwarded to the scrubber-cooler 80. In the scrubber-cooler 80, water, supplied through line 76, condenses the vapor in the gases. The liquid from the scrubber-cooler leaves this unit through conduit 78 and may be returned to the head of the sewage plant. Sewage may be substituted for the water in the scrubber-cooler, if desired, to reduce the total amount of liquids which must be handled by the plant. The gases, now saturated with moisture at, say, 35° C., leave the scrubber-cooler 80 through conduit 82 which conducts the gases to the fluidizing blower 84, where this gas is combined with additional air introduced through air in-take 87 and forwarded to the incinerator and dryer units through heat exchanger 90 via conduit 86.

The incinerator 40 receives its charge of solids through the aforementioned transfer pipe 23 through which both sand and dry sludge are introduced into fluid bed 44. In addition, as previously mentioned, particulate dry solids are supplied to the fluid bed 44 from the cyclone 70 through the conduit 72, these latter being the solids removed from the off-gases of the fluid bed dryer 20. Some loss of bed sand occurs in operation and the sand inventory may be replenished from time to time by introducing sand into bed 44 through the inclined portion of conduit 72 or through separate charge means (not shown). Fuel is supplied to the bed 44 by one or more fuel guns 51 which penetrate the sidewall of the fluid bed incinerator 40 to deliver fuel directly into the fluidized bed 44. It is contemplated that fuel oil injection will not be required under usual operating conditions, but such fuel injection may be required from time to time when the fuel value supplied by the dry sludge is not sufficient to sustain autogenous combustion. Preheated fluidizing gas is supplied to the wind box 46 of incinerator unit 40 through the conduit 38. This gas passes through the constriction plate 43 to fluidize bed 44.

For purposes of temperature control, water may be injected into the combustion chamber 42 of the incinerator unit 40 through conduit 45. Combustion of the dried sewage sludge occurs primarily within fluidized bed 44 where the temperature is about 700° F., but combustion of sludge particles ejected from the bed and of combustible gases occurs to a certain extent above the bed level in combustion chamber 42, where the temperature may be expected to reach the level of about 815° C. The exhaust gases from the combustion chamber 42 leave the chamber through conduit 52 and then traverse the heat exchanger 90. The exhaust gases after this heat exchange with the incoming fluidizing air leave the heat exchanger through conduit 94 and are then conducted to the venturi scrubber 100 which is of essentially conventional design. Gases leave the scrubber through the exhaust stack 104 while the liquids and solids leave the scrubber through conduit 102. It will be noted that the gases having their origin in the fluid bed drying unit 20 appear at the fluidizing blower 84 for mixture with incoming combustion air, admitted by air in-take 87, and these gases are forwarded through conduit 86 to the heat exchanger 90, where they are heated to a suitable temperature, say 480° C. The pre-heated gases leave the heat exchanger through a conduit 88 and the flow is then split between conduits 38 and 18 for supply of pre-heated air to the wind boxes 46 and 16 of the fluid bed incinerator 40 and drying unit 20, respectively. The odorous gases from the fluid bed dryer 20 are thus subjected to the high temperature prevailing in the combustion chamber 44 of incinerator unit 40 and the odors so destroyed.

FIG. 2*a* shows a portion of a system similar to that of FIG. 1 with a multiple hearth furnace or dryer substituted for the fluidized bed dryer. The multiple hearth dryer 120 has individual hearths, 171, 175, 177, 179 which are cantilevered from the inner wall of the dryer. The hearths are of an annular configuration defining a central opening in which a shaft 203 is received. The topmost hearth 171 has a central opening 191 through which the moist charge can pass downwardly to the next lower hearth 175. Hearth 175 has peripheral openings 193 forming spaced downcomers for the feed. The next lower hearth 177 has a central opening at 195 and openings 197 are provided through the lowest hearth, thereby defining a zig-zag path for the feed undergoing drying.

The shaft 203 carries at the level of each hearth a plurality of generally radial rake arms 221. The stirring teeth of the rake arms are inclined to the direction of rotation to convey the waste inwardly or outwardly to the central opening or peripheral openings, as the case may be.

In operation of the dryer, moist feed or sludge is furnished to dryer 120 by a feed device 122; for example, a screw conveyor. Hot, inert particulates are furnished to the dryer 120 from the fluidized bed incinerator by the transfer pipe 125. The sludge and hot particulates are stirred and mixed on the topmost hearth 171, where substantial evolution of water vapor and other gases occurs. The still moist feed is further dried as it progresses downwardly on successive hearths and, ultimately, the dried feed is discharged into the fluidized bed incinerator through openings 197 and transfer pipes 123. The gas and vapor are discharged from dryer 120 through exhaust conduit 48 and received the same treatment described in connection with the treatment of off-gases from dryer 20 of FIG. 2. Heated air may be supplied to dryer 120 through conduit 18.

Considering the dryer unit alone, it is clear that furnishing air to the dryer may not be necessary in all cases. Very large volumes of vapor are created by contacting the moist feed with hot sand and this vapor will flow from the dryer unit under its own pressure, if an appropriate conduit is provided. With such a conduit connected to a condenser, most of the vapor will be condensed therein and can be drawn off anddisposed of as liquid, the vapor remaining adjacent or associated with the feed under these circumstances is only a small fraction of the original moisture. Such a feed is effectively "dry".

The embodiments of the invention which have been illustrated incorporate a heat exchanger for recuperating heat from the reactor exhaust gas to preheat the air for the combustion reactor. A saving in capital cost, at some sacrifice in efficiency, can be effected by eliminating the heat exchanger. In this embodiment of the invention, air at ambient temperature is used as the drying and combustion air and the reactor exhaust gas is routed directly to the venturi scrubber and exhaust stack.

While sand is the usual particulate material employed, since it is quite inert and relatively inexpensive, other particulate bed materials, such as $Al_2O_3$ and MgO, may be employed in special circumstances. Ash generated in combustion may also be employed as partial or complete replacement for sand if the ash produced has suitable physical properties.

In some cases it may be necessary or advantageous to use a mixed feed; for example, sewage and industrial sludge. The process of the invention readily accomodates such mixed feeds.

Although the present invention has been described in conjunction with preferred embodiments, it is to be understood that modifications and variations may be resorted to without departing from the spirit and scope of the invention, as those skilled in the art will readily understand. Such modifications and variations are considered to be within the purview and scope of the invention and appended claims.

We claim:

1. A process for combustion of moist combustible feed wherein said moist feed is first dried and then introduced into a combustion zone containing inert, particulate material comprising, withdrawing a quantity of hot, inert, particulate material from said combustion zone, intimately contacting said moist feed with said hot particulate material in a drying zone to evaporate the water in the feed at a relatively low temperature, removing water vapor and non-condensible gas from said drying zone in a gas stream, removing the dried solids from said drying zone and charging said dried solids into said combustion zone for combustion, treating said gas stream to remove and dispose of the water vapor therein, forwarding the balance of the gas stream to the combustion zone for deodorizing by heating to elevated temperature and exhausting the gases from said combustion zone to the atmosphere with or without further treatment.

2. The process of claim 1 wherein said gas stream is removed to a closed chamber wherein said water vapor generated by evaporation is condensed for disposal.

3. The process of claim 2 wherein sweep air is passed through said drying zone to aid in transport of water vapor and non-condensible gas to said closed chamber.

4. A system for incineration of moist combustible feed comprising an incinerating unit having a combustion zone therein, means for supplying a mixture of inert particulates and dried feed material to said combustion zone, means for conveying hot, inert particulates from said combustion zone to a dryer unit having a drying zone therein wherein said particulates are mixed with moist feed, conduit means for conducting water vapor and other gases generated in said drying zone to a condensation zone, means for discharging water from said condensation zone and conduit means connecting said condensation zone to said combustion zone to conduct non-condensible gases from said condensation zone to said combustion zone.

* * * * *

UNITED STATES PATENT AND TRADEMARK OFFICE

CERTIFICATE OF CORRECTION

PATENT NO. : 4,232,614

DATED : November 11, 1980

INVENTOR(S) : E. B. Fitch and O. E. Albertson

It is certified that error appears in the above-identified patent and that said Letters Patent are hereby corrected as shown below:

Column 2, line 45, delete "combination" and substitute --combustion--.

Column 3, line 51, delete "exchanges" and substitute --exchangers--.

Signed and Sealed this

*Third* Day of *March 1981*

[SEAL]

*Attest:*

RENE D. TEGTMEYER

*Attesting Officer*

*Acting Commissioner of Patents and Trademarks*

REEXAMINATION CERTIFICATE (470th)

United States Patent [19] [11] B1 4,232,614

Fitch et al. [45] Certificate Issued Feb. 25, 1986

[54] PROCESS OF INCINERATION WITH PREDRYING OF MOIST FEED USING HOT INERT PARTICULATES

[75] Inventors: Elliot B. Fitch, Auburn, Ala.; Orris E. Albertson, Salt Lake City, Utah

[73] Assignee: Dorr-Oliver Incorporated, Stamford, Conn.

Reexamination Request:
No. 90/000,796, Jun. 11, 1985

Reexamination Certificate for:

| | |
|---|---|
| Patent No.: | **4,232,614** |
| Issued: | **Nov. 11, 1980** |
| Appl. No.: | **46,392** |
| Filed: | **Jun. 6, 1979** |

Certificate of Correction issued Mar. 3, 1981.

Related U.S. Application Data

[63] Continuation-in-part of Ser. No. 856,379, Dec. 1, 1977, Pat. No. 4,159,682.

[51] Int. Cl.[4] ..... F23G 5/04

[52] U.S. Cl. ..... 110/235; 110/224; 110/238; 110/245; 110/246; 110/346

[58] Field of Search ..... 110/235, 238, 243, 245, 110/246, 254, 219, 221, 224, 229, 346; 432/15, 58

[56] References Cited

FOREIGN PATENT DOCUMENTS 117271 of 1975 Japan

*Primary Examiner*—Edward G. Favors

[57] ABSTRACT

Moist combustible matter is burned in a combustion zone following a drying treatment in which the combustible matter is brought into contact with hot, inert particulates circulated from the combustion zone. The water in the combustible matter is evaporated at a relatively low temperature in the drying zone, thereby conserving heat in the system. The exhaust gas stream from the drying zone is handled separately from the reactor exhaust gases to condense the water vapor therein, the water is removed from the process and the remaining gas is subjected to odor-destroying high temperature.

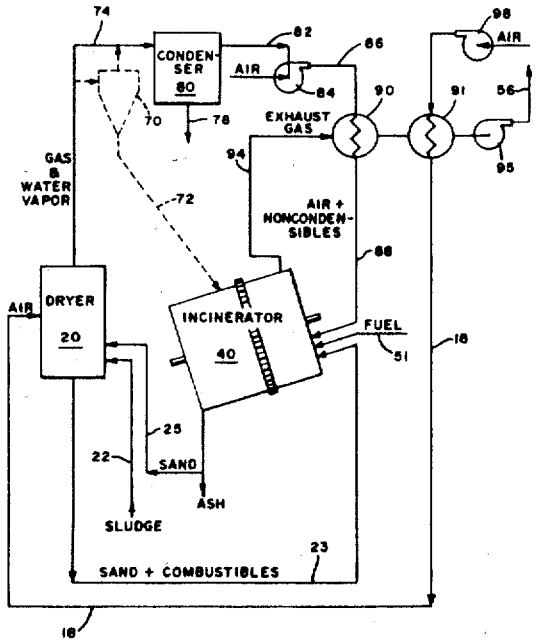

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claim 3 is cancelled.

Claims 1 and 4 are determined to be patentable as amended.

Claim 2, dependent on a amended claim, is determined to be patentable.

1. A process for combustion of moist combustible feed wherein said moist feed is first dried and then introduced into a combustion zone containing inert, particulate material comprising, withdrawing a quantity of hot, inert, particulate material from said combustion zone, intimately contacting said moist feed with said hot particulate material in a drying zone *without any substantial addition of air* to evaporate the water in the feed at a relatively low temperature, removing water vapor and non-condensable gas from said drying zone in a gas stream, removing the dried solids from said drying zone and charging said dried solids into said combustion zone for combustion, treating said gas stream to remove and dispose of the water vapor therein, forwarding the balance of the gas stream to the combustion zone for deodorizing by heating to elevated temperature and exhausting the gases from said combustion zone to the atmosphere with or without further treatment.

4. A system for incineration of moist combustible feed comprising an incinerating unit having a combustion zone therein, means for supplying a mixture of inert particulates and dried feed material to said combustion zone, *a dryer unit spaced from said incinerating unit and having a drying zone therein,* means for conveying hot, inert particulates from said combustion zone to [a dryer unit having a] *said* drying zone [therein wherein said particulates are mixed with] *said drying zone having means to admit* moist feed *and to intimately mix said hot, inert particulates and said moist feed without the introduction or addition of any substantial amount of air,* conduit means for conducting water vapor and other gases generated in said drying zone to a condensation zone, means for discharging water from said condensation zone and conduit means connecting said condensation zone to said combustion zone to conduct non-condensible gases from said condensation zone to said combustion zone.

* * * * *